US009637879B2

(12) United States Patent
Impero

(10) Patent No.: US 9,637,879 B2
(45) Date of Patent: May 2, 2017

(54) FRONTAL IMPACT CRASH BARRIER FOR USE IN AUTOMOBILE OR MOTORCYCLE RACING CIRCUITS

(71) Applicant: Pasquale Impero, Casalnuovo di Napoli (IT)

(72) Inventor: Pasquale Impero, Casalnuovo di Napoli (IT)

( * ) Notice: Subject to any disclaimer, the term of this patent is extended or adjusted under 35 U.S.C. 154(b) by 0 days.

(21) Appl. No.: 14/909,836

(22) PCT Filed: Aug. 4, 2014

(86) PCT No.: PCT/IB2014/063683
§ 371 (c)(1),
(2) Date: Feb. 3, 2016

(87) PCT Pub. No.: WO2015/019275
PCT Pub. Date: Feb. 12, 2015

(65) Prior Publication Data

US 2016/0168811 A1 Jun. 16, 2016

(30) Foreign Application Priority Data

Aug. 6, 2013 (IT) ..... BO2013A0448

(51) Int. Cl.
*E01F 15/14* (2006.01)
*E01F 15/02* (2006.01)
*E01F 15/08* (2006.01)

(52) U.S. Cl.
CPC ..... *E01F 15/146* (2013.01); *E01F 15/025* (2013.01); *E01F 15/085* (2013.01);
(Continued)

(58) Field of Classification Search
CPC ..... E01F 15/00; E01F 15/14; E01F 15/145; E01F 15/146; E01F 15/025; E01F 15/086; E01F 15/088
See application file for complete search history.

(56) References Cited

U.S. PATENT DOCUMENTS 3,951,384 A * 4/1976 Hildreth, Jr. ..... E01F 15/003 114/219
4,785,577 A * 11/1988 Lederbauer ..... E01F 8/023 256/13.1

(Continued)

FOREIGN PATENT DOCUMENTS

DE 103 24 363 A1 12/2004
FR 2 742 776 A1 6/1997
FR 2 911 886 A1 8/2008

OTHER PUBLICATIONS

Hexcel Composites, HexWeb Honeycomb Sandwich Design Manual (2000).†

(Continued)

*Primary Examiner* — Abigail A Risic
(74) *Attorney, Agent, or Firm* — R. Neil Sudol; Henry D. Coleman

(57) ABSTRACT

A frontal-impact crash barrier (1) for use in automobile or motorcycle racing circuits, comprising a plurality of impact-absorbing units (2) arranged in reciprocal contact, each in turn comprising: a longitudinal body (3) having an external lateral surface (15), which is hollow and which is arranged vertically; and a plurality of annular elements (4) which are inserted along the longitudinal body (3) so as to externally embrace the longitudinal body (3) and which are stacked on one another so as to enclose the longitudinal body (3) so that the external lateral surface (15) of the longitudinal body (3) is entirely facing the plurality of annular elements (4). The longitudinal body (3) of each impact-absorbing unit (2) can be made of metal. Each transversal section of the longitudinal body (3) of each impact-absorbing unit (2) has a thickness forming a polygon having five sides, or six sides or seven sides.

8 Claims, 11 Drawing Sheets

(52) U.S. Cl.
CPC ..... *E01F 15/086* (2013.01); *E01F 15/088* (2013.01); *E01F 15/145* (2013.01)

(56) References Cited

U.S. PATENT DOCUMENTS 5,006,014 A * 4/1991 Greenough ..... E02B 3/20 405/60.5
5,178,489 A * 1/1993 Suhayda ..... E02B 3/06 405/16
5,645,368 A * 7/1997 Yunick ..... E01F 15/0453 256/13.1
5,778,622 A * 7/1998 Baker ..... E02D 17/205 264/275
6,340,268 B1 † 1/2002 Alberson
6,905,281 B2 * 6/2005 Kang ..... E01F 15/146 404/6
2003/0168650 A1 * 9/2003 Alberson ..... E01F 15/146 256/13.1
2004/0025451 A1 * 2/2004 Barton ..... E01F 15/145 52/174
2005/0236609 A1 * 10/2005 Talbott ..... E01F 15/086 256/1
2006/0103061 A1 * 5/2006 Kennedy, Jr. ..... C08G 18/10 267/116
2007/0140790 A1 * 6/2007 Lotsberg ..... E01F 15/0453 404/6
2008/0181722 A1 * 7/2008 McKenney ..... E01F 15/146 404/6
2010/0080652 A1 * 4/2010 Shin ..... E01F 15/146 404/6
2011/0091273 A1 * 4/2011 Sayre ..... C08G 18/10 404/6
2012/0121325 A1 * 5/2012 Buehler ..... E01F 15/146 404/6
2014/0130725 A1 * 5/2014 Liu ..... E01F 15/141 114/219
2014/0301781 A1 * 10/2014 Lindberg ..... E01F 15/146 404/6

OTHER PUBLICATIONS

Carney III, John F. and Gripne, Don J. "Development of Maintenance-Free Highway Safety Appurtenances." Washington State Transportation Commission (1992).†

* cited by examiner
† cited by third party

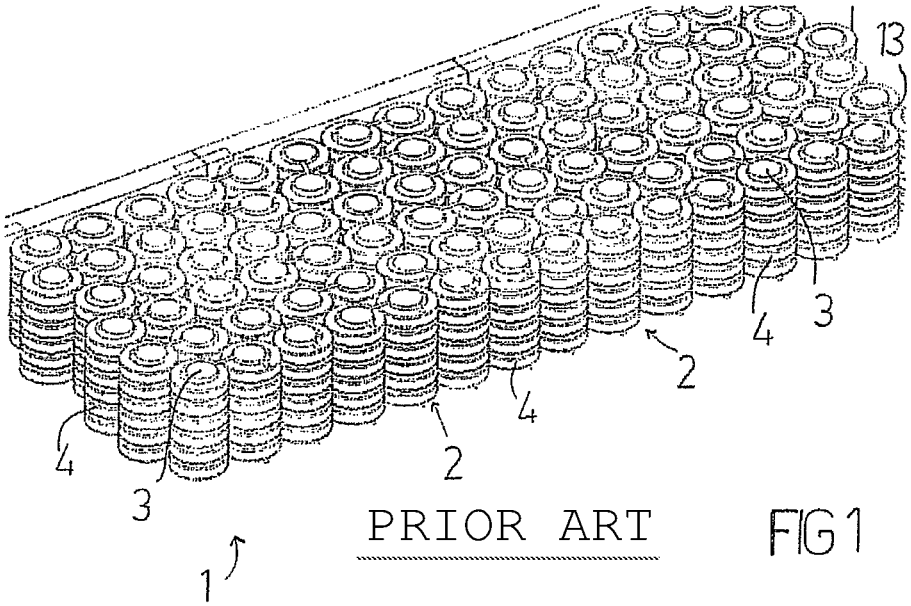
PRIOR ART FIG1
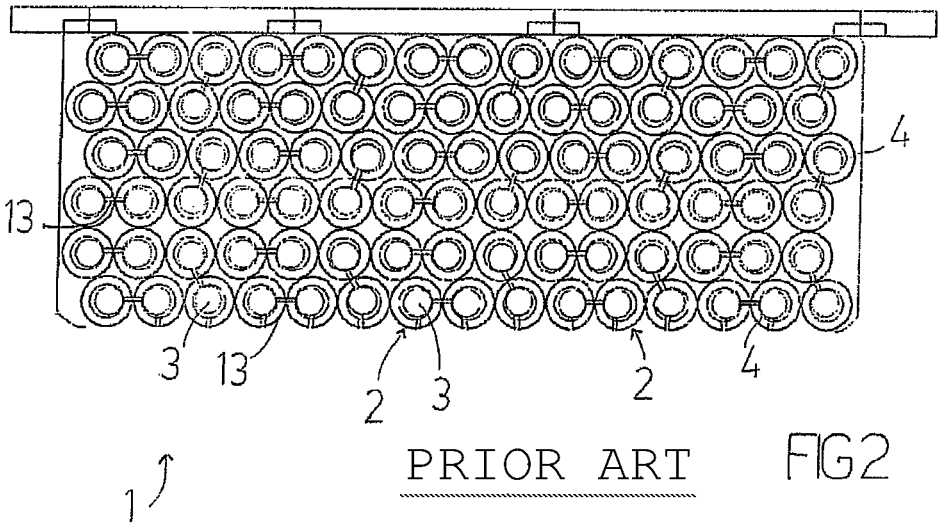
PRIOR ART FIG2

| | L [mm] | H [mm] | L/H |
|---|---|---|---|
| ***B1*** | 128 | 174 | 0.74 |
| ***B2*** | 128 | 177 | 0.72 |
| ***B3*** | 128 | 183 | 0.69 |
| ***B4*** | 128 | 190 | 0.67 |
| ***B5*** | 128 | 195 | 0.65 |
| ***B6*** | 100 | 219 | 0.45 |
| ***B7*** | 100 | 200 | 0.50 |
| ***B8*** | 156 | 195 | 0.80 |
| ***B9*** | 156 | 174 | 0.90 |
FIG5
FIG6
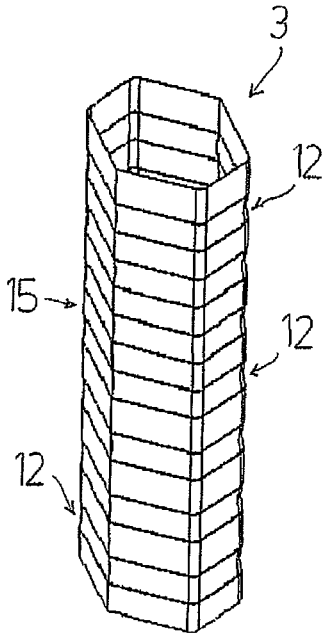
FIG7
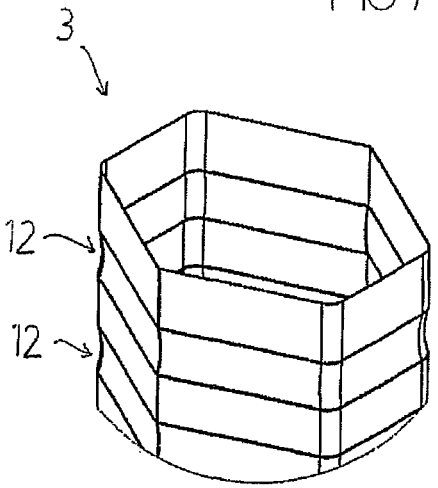

FRONTAL IMPACT CRASH BARRIER FOR USE IN AUTOMOBILE OR MOTORCYCLE RACING CIRCUITS

FIELD OF THE INVENTION

The present invention relates to the technical sector concerning frontal-impact crash barriers for use in automobile or motorcycle racing circuits.

DESCRIPTION OF THE PRIOR ART

As is known, automobile or motorcycle racing circuits are externally provided with frontal-impact crash barriers. A frontal-impact crash barrier (1) of the prior art is illustrated in FIG. 1, and comprises a plurality of impact-absorbing units (2) arranged in reciprocal contact, each in turn comprising: a longitudinal body (3) which is hollow and arranged vertically; and a plurality of annular elements (4) which are inserted along the longitudinal body (3) so as to externally embrace the longitudinal body (3) and which are stacked on one another so as to enclose the longitudinal body (3).

In particular, the longitudinal body (3) is a tubular element made of polyethylene, having a transversal sector with a thickness of 30 mm and a circular shape.

The annular elements (4) are instead tyres stacked on one another.

The adjacent impact-absorbing units (2) can be constrained to one another by means of connecting bands (13) (made of metal or textile) between the relative longitudinal bodies (3).

The International Automobile Federation (FIA) recommends that during a frontal impact of a vehicle against a frontal-impact crash barrier (1), the peak of deceleration, measured at the centre of gravity of the vehicle, does not exceed a limit value which at present in 60 g, where "g" is gravitational acceleration.

The barrier of FIG. 1 comprises six rows of impact-absorbing units (2), and satisfies this condition if the impacting vehicle does not exceed the speed limit of 160 km/h. To increase the allowed speed limit, it is theoretically possible to increase the number of rows of impact-absorbing units (2): by doing this, however, there is the risk that the vehicle might wedge itself below the tyres, which might place the driver's safety in danger.

SUMMARY OF THE INVENTION

The aim of the invention therefore consists in obviating the above-cited drawback.

The above aim is attained with a frontal-impact crash barrier for use in automobile and motorcycle racing circuits according to claim 1.

Experiments have shown that each impact-absorbing unit (2) is able to absorb a greater quantity of kinetic energy during a frontal impact with respect to an impact-absorbing unit of known type (2), as described above.

Consequently the use of the frontal-impact crash barrier (1) of the invention enables raising the speed limit within which an impacting vehicle can be stopped with safety.

BRIEF DESCRIPTION OF THE DRAWINGS

Specific embodiments of the invention will be described in the following of the present description, in accordance with what is set down in the claims and with the aid of the accompanying tables of drawings, in which:

FIGS. 1, 2 are respectively a perspective view and a view from above of a prior-art frontal-impact crash barrier, used in automobile or motor-cycle racing circuits;

FIG. 5 is a table which includes significant values referring to geometric dimensions of the longitudinal body of an impact-absorbing unit according to the preferred embodiment of the invention;

FIG. 6 is a perspective view of the longitudinal body of an impact-absorbing unit according to another preferred embodiment of the present invention;

FIG. 7 illustrates a larger-scale view of FIG. 6;

DESCRIPTION OF PREFERRED EMBODIMENTS

Figure 3:
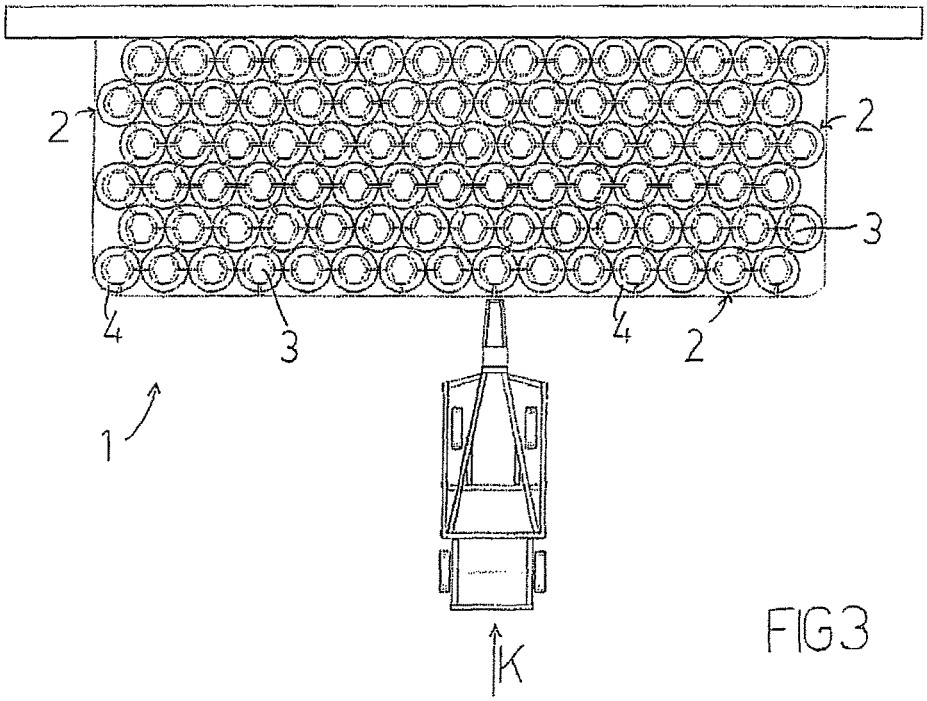
FIG. 3 is a view from above of a frontal-impact crash barrier for use in automobile or motor-cycle racing circuits, and a vehicle which is about to frontally impact the frontal-impact crash barrier.
Figure 4:
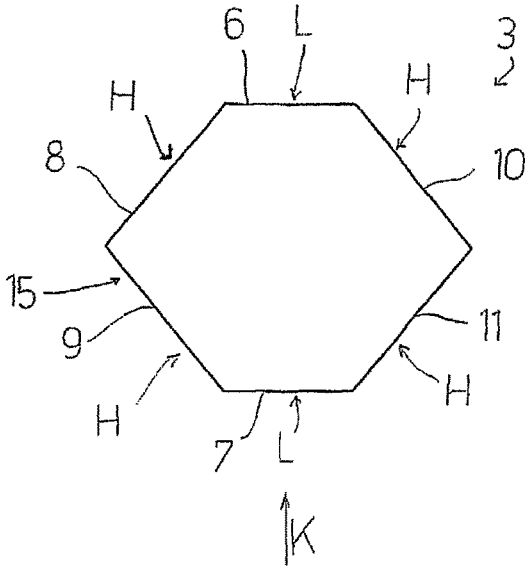
FIG. 4 is a view from above of the longitudinal body (in which the thickness is not represented) of an impact-absorbing unit which is a part of the frontal-impact crash barrier, according to a preferred embodiment of the invention.

With reference to the accompanying tables of drawings, (1) denotes in its entirety a frontal-impact crash barrier for use in automobile or motor-cycle racing circuits, which is the object of the present invention.

The frontal-impact crash barrier (1) comprises: a plurality of impact-absorbing units (2) arranged in reciprocal contact, each in turn comprising: a longitudinal body (3) which has an external lateral surface (15) that is hollow and which is arranged vertically; and a plurality of annular elements (4) which are inserted along the longitudinal body (3) so as to externally embrace the longitudinal body (3) and which are stacked on one another so as to enclose the longitudinal body (3) so that the external lateral surface (15) of the longitudinal body (3) is entirely facing the plurality of annular elements (4). Each transversal section of the longitudinal body (3) of each impact-absorbing unit (2) has a thickness forming a polygon having five sides, or six sides or seven sides.

Each impact-absorbing unit (2) preferably comprises a single longitudinal body (3) (see FIGS. 3, 4, 6, 7, 13-20).

The longitudinal body (3) of each impact-absorbing unit (2) is preferably made of metal.

The longitudinal body (3) can have a transversal section that is identical along a whole length thereof.

FIGS. 8-12 are graphs, each illustrating on the y-axis the deceleration and on the x-axis the time: the deceleration values are provided in terms of gravity acceleration g, while the time values are provided in terms of milliseconds.

Figure 8:
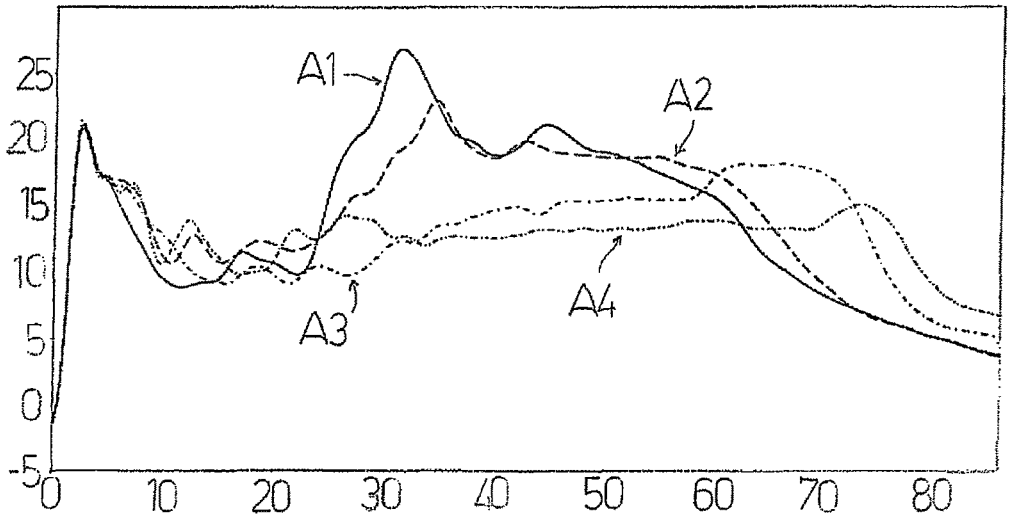
FIGS. 8-12 illustrate five graphs relative to the progression of the deceleration over time of a vehicle frontally impacting against an impact-absorbing unit the longitudinal body of which exhibits different characteristics time by time.
Figure 9:
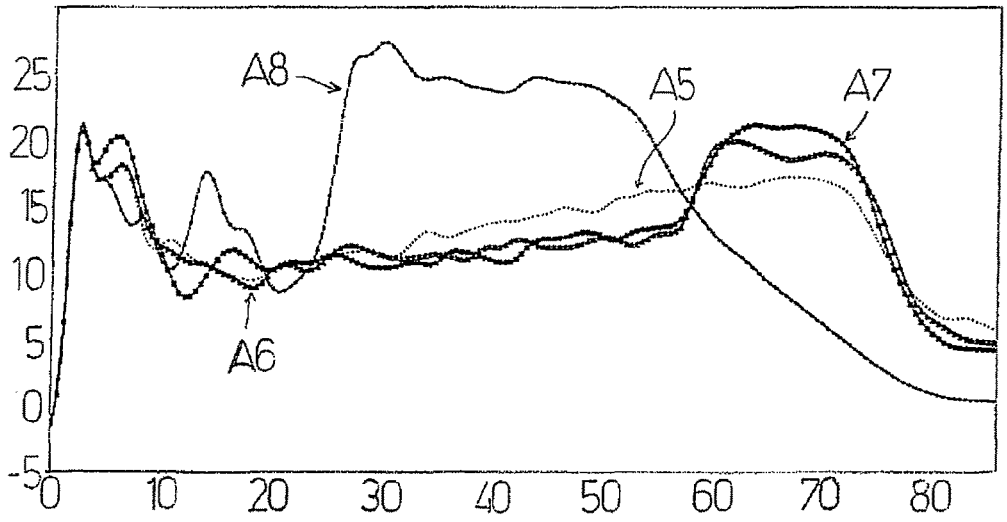

The graphs of FIGS. 8 and 9 show the progression of the deceleration over time of a vehicle which frontally impacts an impact-absorbing unit (2): in a case in which the kinetic energy is $1.6-e^4$ Joule (this is given by way of non-limiting example), the longitudinal body (3) is made of metal and the longitudinal body (3) has a constant transversal section with a thickness that forms a three-sided polygon (see reference A1 in FIG. 8), a four-sided polygon (see reference A2 in FIG. 8), a five-sided polygon (see reference A3 in FIG. 8), a six-sided polygon (see reference A4 in FIG. 8), a seven-sided polygon (see reference A5 in FIG. 9), an eight-sided polygon (see reference A6 in FIG. 9) or a circle (see reference A7 in FIG. 9).

The graph of FIG. 9 further illustrates the progression of the deceleration over time of a vehicle which frontally impacts an impact-absorbing unit (2) of known type, i.e. in a case in which the relative longitudinal body (3) is a tubular element made of polyethylene in which the thickness of the transversal section forms a circle (see reference A8 in FIG. 9).

As is known, an impact-absorbing unit (2) is progressively more efficient, and therefore able to absorb a greater quantity of kinetic energy during a frontal impact, the more the curve expressing the progression of the deceleration as a function of time is horizontal (leaving aside an initial peak, which cannot be modified).

It is therefore clear (looking at the graphs of FIG. 8 and FIG. 9) that there is an advantage in using impact-absorbing units (2) according to the invention, i.e. comprising a longitudinal body (3) made of metal and having a transversal section with a thickness forming a five-sided polygon or a six-sided or seven-sided polygon.

FIGS. 13-20 each illustrate a transversal section of an impact-absorbing unit (2) of the prior art, discussed in the preamble hereto, and an impact-absorbing unit (2) according to the invention in which the longitudinal body (3) in particular has a constant transversal section with a thickness forming a six-sided polygon. In particular, FIGS. 13-16 illustrate the two impact-absorbing units (2) mentioned above after a frontal impact with kinetic energy of $3.5-e^4$ Joule, respectively after 15 ms, 30 ms, 45 ms, 60 ms; instead, FIGS. 17-20 illustrate the two above-mentioned impact-absorbing units (2) after a frontal impact with kinetic energy of $5.1-e^4$ Joule, respectively after 15 ms, 30 ms, 45 ms, 60 ms. In the progressive crushing of the above-described impact-absorbing units (2), at the transversal section of the longitudinal body (3) of the impact-absorbing unit (2) of the invention six plastic hinges (5) are formed at the corners while in the transversal section of the longitudinal body (3) of the impact-absorbing units (2) of the prior art only two plastic hinges (5) are formed, arranged on a perpendicular plane to the impact direction (K).

The greater efficiency of the impact-absorbing units (2) that are part of the frontal-impact absorbing barrier (1) of the invention is due to the fact that in each transversal section of the longitudinal body (3) plastic hinges (5) are formed at each corner of the six-sided polygon; this is true also in a case in which each transversal section of the longitudinal body (3) of the impact-absorbing unit (2) has a thickness which forms a five-sided polygon or a six-sided polygon. If each transversal section of the longitudinal body (3) has a thickness which forms a four-sided polygon or a three-sided polygon (FIG. 8), the number of plastic hinges (5) that form at each corner is limited, being respectively equal to four plastic hinges (5) and three plastic hinges (5); the behaviour of a corresponding impact-absorbing unit (2) is consequently not satisfactory, as shown by FIG. 8. If, instead, each transversal section of the longitudinal body (3) has a thickness which forms a polygon having a number of sides that is equal to or greater than eight (FIG. 9), a number of plastic hinges (5) is formed which is lower than the number of corners of the corresponding polygon, which number is two (as in the case of the circle) if the polygon has more than ten sides; in this case too the behaviour of a corresponding impact-absorbing unit (2) is not satisfactory.

In a preferred embodiment, each transversal section of the longitudinal body (3) of each impact-absorbing unit (2) has a thickness which forms a six-sided polygon (FIG. 4), which six-sided polygon comprises a first side (6), a second side (7), a third side (8), a fourth side (9), a fifth side (10) and a sixth side (11); the first side (6) and the second side (7) are opposite and have a same first length (L); the third side (8), the fourth side (9), the fifth side (10) and the sixth side (11) have instead a second length (H). The impact-absorbing unit (2) of the plurality of impact-absorbing units (2) are orientated so that a frontal impact acts in a direction (K) (see FIG. 3) which is perpendicular to the first side (6) and the second side (7) of each transversal section of the longitudinal body (3) of each impact-absorbing unit (2). Experiments have shown that an frontal-impact crash barrier (1) comprising a plurality of impact-absorbing units (2) of this type and the above-specified orientation is more efficient.

Figure 10:
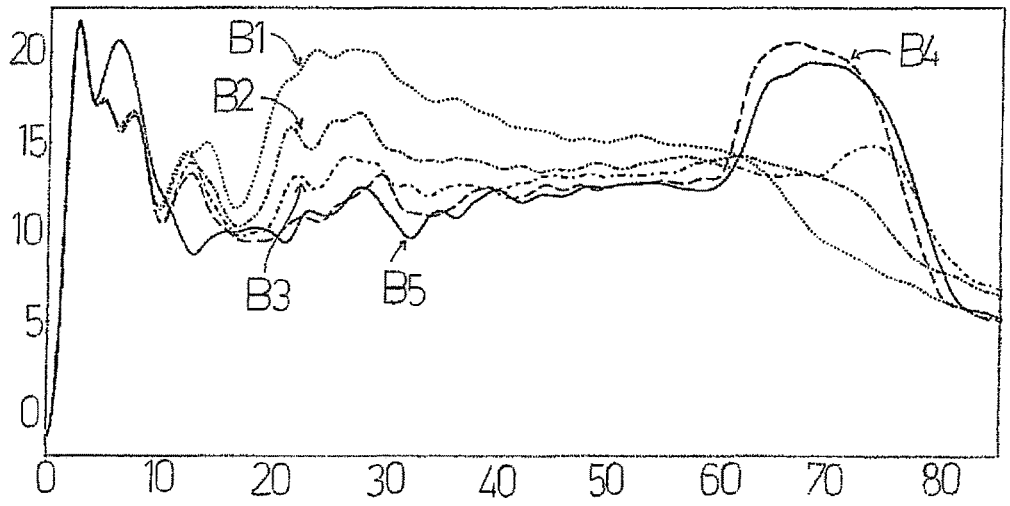
Figure 11:
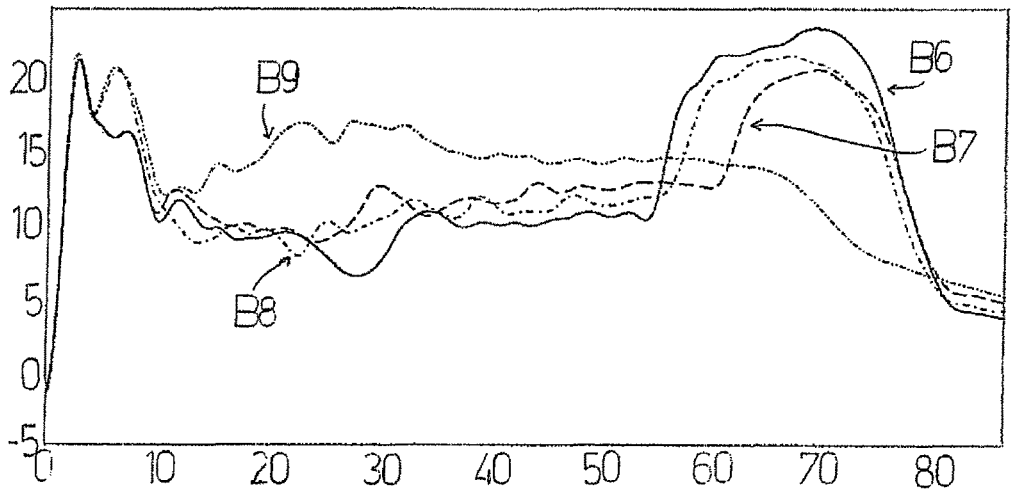

The graphs of FIGS. 10 and 11 illustrate the progression of the deceleration over time of a vehicle which frontally impacts the impact-absorbing unit (2) according to the preferred embodiment discussed in the foregoing, in a case in which the kinetic energy is $1.6-e^4$ Joule (this is given by way of non-limiting example) and on variation of the ratio (L/H) between the first length (L) and the second length (H) (references B1-B9), according to the values reported for example in the table of FIG. 5. As can be observed in the graphs, preferably for each impact-absorbing unit (2) the ratio (L/H) between the first length (L) and the second length (H) falls into a range comprised between 0.6 and 0.8; in fact, in this range the curve expressing the progression of the deceleration as a function of time better approximates a horizontal straight line.

Still more preferably, the ratio (L/H) between the first length (L) and the second length (H) is about 0.69.

Each longitudinal body (3) can be formed by two longitudinal half-shells (not illustrated) which are identical, opposite and welded to one another.

The longitudinal body (3) of each impact-absorbing unit (2) preferably shapes a plurality of recesses (12) spaced from one another, each recess (12) developing in a closed loop about an axis of the longitudinal body (3). Therefore, each recess (12) develops in a perimeter direction to the longitudinal body (3) (FIGS. 6 and 7).

Each recess (12) of the plurality of recesses (12) preferably develops transversally to the axis of the longitudinal body (3).

The recesses (12) of the plurality of recesses (12) are preferably parallel to one another.

Figure 12:
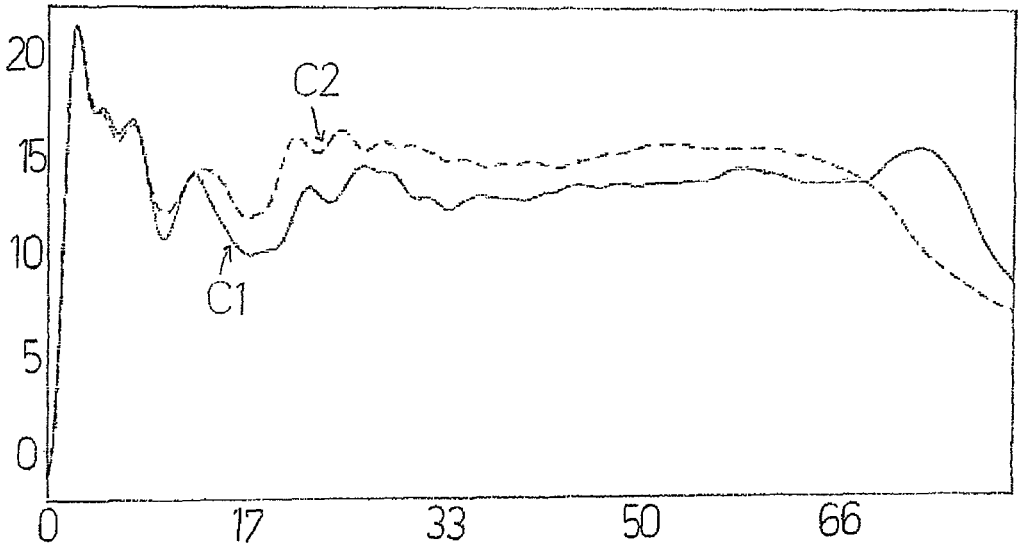
Figure 13:
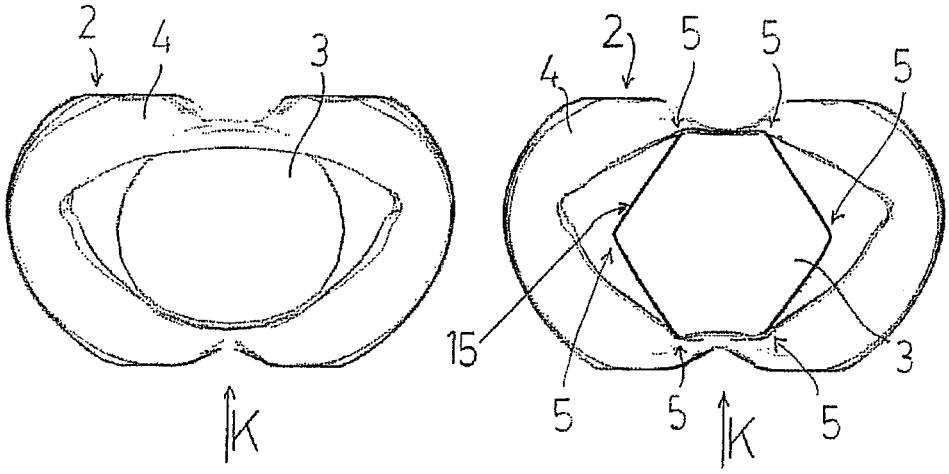
FIGS. 13-16 illustrate the progressive crushing of an impact-absorbing unit of the prior art, and an impact-absorbing unit according to the invention, in a case of a frontal impact having a first value of kinetic energy.
Figure 14:
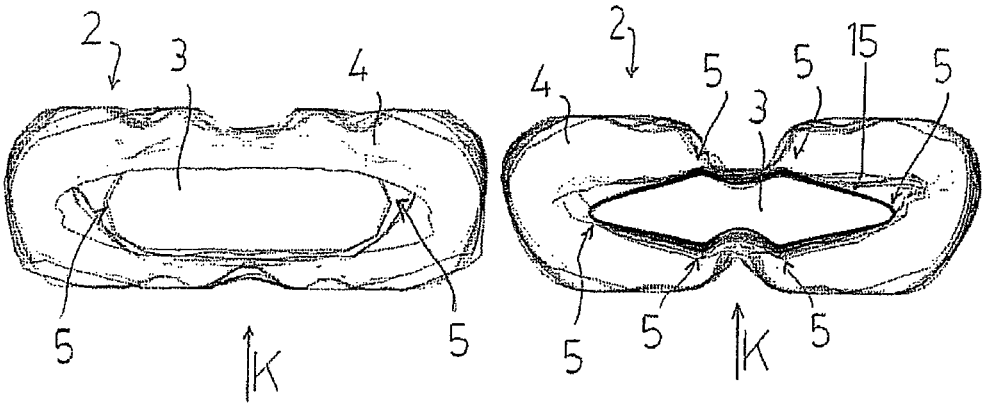
Figure 15:
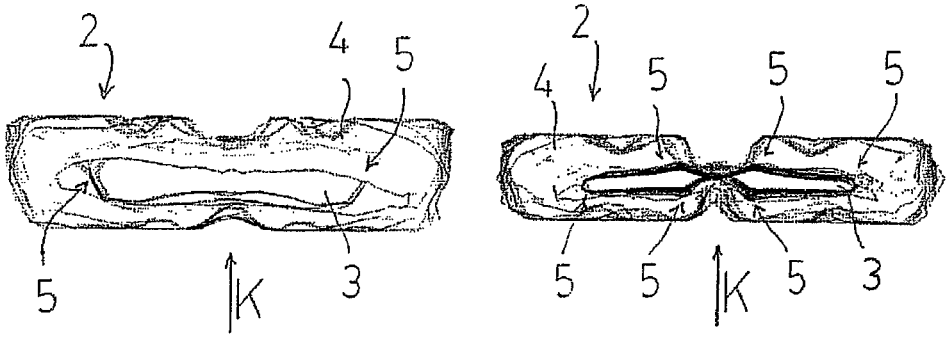
Figure 16:
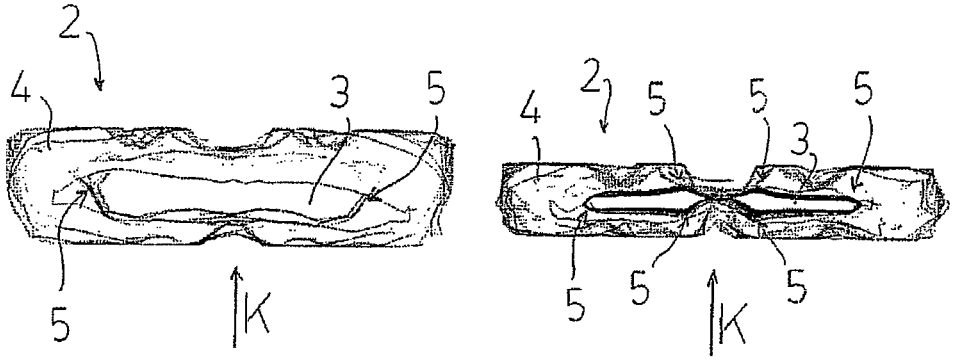
Figure 17:
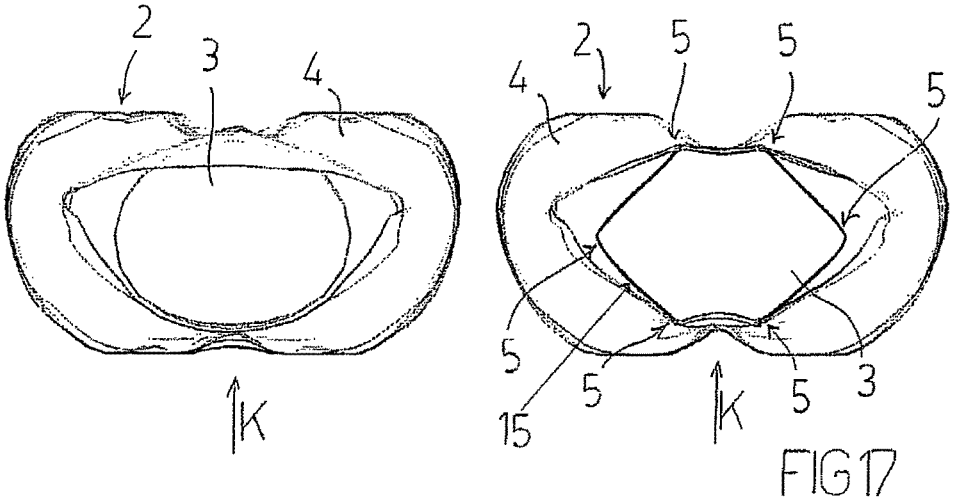
FIGS. 17-20 illustrate the progressive crushing of an impact-absorbing unit of the prior at and an impact-absorbing unit of the invention, in a case of a frontal impact having a second value of kinetic energy.
Figure 18:
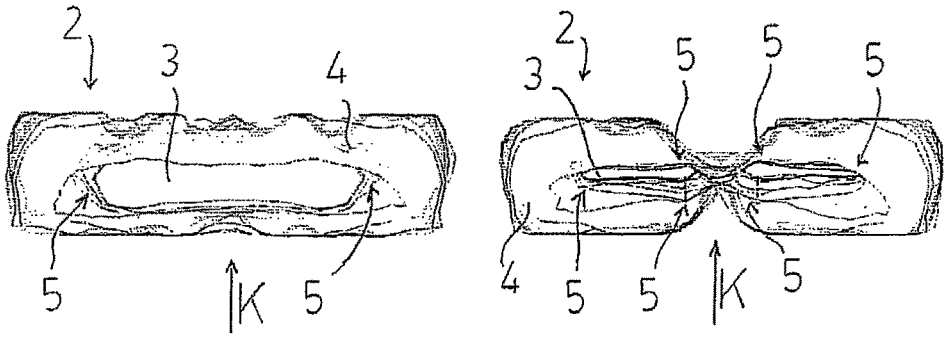
Figure 19:
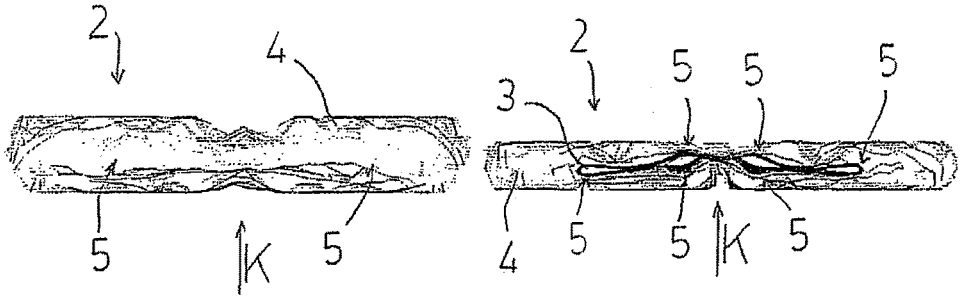
Figure 20:
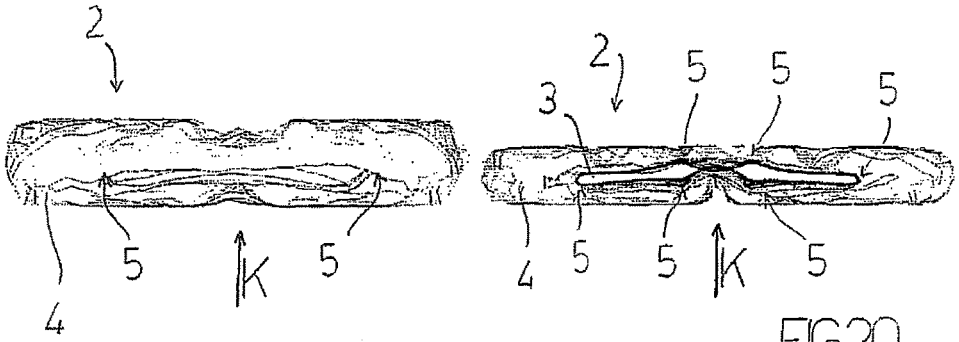

The graph of FIG. 12 shows the progression of deceleration over time of a vehicle frontally impacting an impact-absorbing unit (2) in a case in which the kinetic energy is $1.6-e^4$ Joule, the longitudinal body (3) is made of metal, the longitudinal body (3) has a constant transversal section with a thickness forming a six-sided polygon, with the first side (6) and the second side (7) having a same first length (L) and the third side (8), the fourth side (9), the fifth side (10) and the sixth side (11) having a same second length (H), the ratio (L/H) between the first length (L) and the second length (H) being 0.69 (see the curve denoted by reference (C1).

The curved denoted with reference (C2), on the other hand, relates to an impact-absorbing unit (2) which is different from the above-described example in that the plurality of recesses (12) is included (the transversal section is therefore not constant), which are in particular parallel and develop transversally to the axis of the longitudinal body (3).

Form a comparison of the two curves (C1, C2) it is clear that it is even more advantageous to use a frontal-impact crash barrier (1) comprising a plurality of impact-absorbing units (2) the longitudinal bodies of which are provided with recesses (12).

Figure 21:
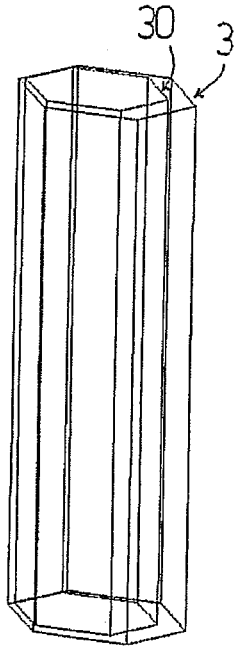
FIG. 21 illustrates a perspective schematic view of a first longitudinal body and a second longitudinal body (of which the thickness has not been represented) of an impact-absorbing unit according to a further embodiment of the present invention.
Figure 22:
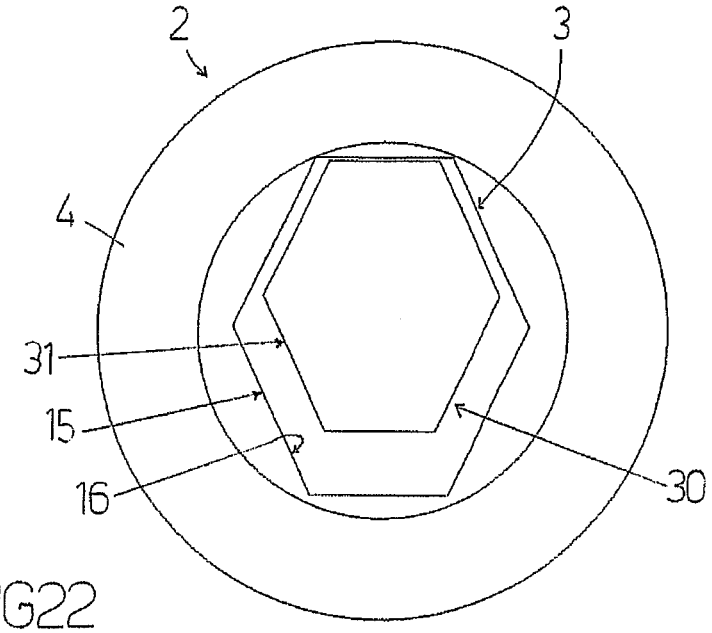
FIG. 22 is a schematic view from above of an impact-absorbing unit comprising the first longitudinal body and the second longitudinal body of FIG. 21.

A further embodiment of the frontal-impact crash barrier (1) for use in automobile or motorcycle racing circuits comprises a plurality of impact-absorbing units (2) arranged in reciprocal contact, each in turn comprising: a first longitudinal body (3) which has an external lateral surface (15) and a lateral internal surface (16), which is hollow and vertically-arranged; a plurality of annular elements (4) which are inserted along the first longitudinal body (3) so as to externally embrace the first longitudinal body (3) and which are stacked on one another so as to enclose the first longitudinal body (3) so that the external lateral surface (15) of the first longitudinal body (3) is entirely facing the plurality of annular elements (4); and a second longitudinal body (30) which has an external lateral surface (31) which is hollow and vertically-arranged internally of the first longitudinal body (3) so that the external lateral surface (31) thereof entirely faces the lateral internal surface (16) of the first longitudinal body (3) (see FIGS. 21 and 22). Each transversal section of the first longitudinal body (3) and the second longitudinal body (30) of each impact-absorbing unit (2) has a thickness which forms a polygon having five sides, or six sides, or seven sides.

With reference to FIGS. 21 and 22, the second longitudinal body (30) contacts the first longitudinal body (3); however the second longitudinal body (30) might also not contact the first longitudinal body (3).

Further, again with reference to FIGS. 21 and 22, the second longitudinal body (30) is not concentric with the first longitudinal body (3); however the second longitudinal body (30) can be concentric with the first longitudinal body (3).

The second longitudinal body (30) is preferably fixed to the first longitudinal body (3) by means of fastening bands (not illustrated).

The second longitudinal body (30) preferably also has the same number of sides as the first longitudinal body (3).

The above-described is understood to have been described by way of non-limiting example, and any eventual constructional variants are understood to fall within the protective scope of the present technical solution, as claimed in the following.

The invention claimed is:

1. A frontal-impact crash barrier for use in automobile or motorcycle racing circuits, comprising a plurality of impact-absorbing units arranged in reciprocal contact, each of said impact-absorbing units comprising:

a longitudinal body having an external lateral surface, said longitudinal body being hollow and arranged vertically; and a plurality of annular elements disposed along and surrounding the longitudinal body, said annular elements being stacked on one another so as to enclose the longitudinal body so that the entire external lateral surface of the longitudinal body faces the plurality of annular elements;

wherein:

the longitudinal body of each impact-absorbing unit has a cross-section in the form of a polygon having five sides, or six sides or seven sides.

2. The frontal-impact crash barrier of claim 1, wherein the longitudinal body of each impact-absorbing unit is made of metal.

3. The frontal-impact crash barrier of claim 1, wherein the polygon has six sides and comprises a first side, a second side, a third side, a fourth side, a fifth side and a sixth side, the first side and the second side being opposite one another and having a same first length, the third side, the fourth side, the fifth side and the sixth side having a same second length, the impact-absorbing units of the plurality of impact-absorbing units being oriented such that a frontal impact acts in a direction that is perpendicular to the first side and to the second side of the longitudinal body of each impact-absorbing unit.

4. The frontal-impact crash barrier of claim 3, wherein the ratio between the first length and the second length falls between 0.6 and 0.8.

5. The frontal-impact crash barrier of claim 4, wherein the ratio between the first length and the second length is substantially 0.69.

6. The frontal-impact crash barrier of claim 3, wherein the longitudinal body of each impact-absorbing unit has a plurality of recesses or indentations spaced from one another, each recess or indentation taking the form of a closed loop about an axis of the longitudinal body.

7. The frontal-impact crash barrier of claim 6, wherein each recess or indentation of the plurality of recesses or indentations is in a plane transverse to the axis of the longitudinal body.

8. The frontal-impact crash barrier of claim 7, wherein the recesses or indentations of the plurality of recesses or indentations are parallel to one another.

* * * * *